US005088248A

United States Patent [19]

Manna

[11] Patent Number: 5,088,248

[45] Date of Patent: Feb. 18, 1992

[54] STAIRTREAD WITH POSITIONING AND LOCKING MECHANISM

[75] Inventor: Joseph P. Manna, P.O. Box 408, 495 Town Farm Rd., Pascoag, R.I. 02859

[73] Assignees: Edwin H. Paul; James V. Leicht; Joseph P. Manna

[21] Appl. No.: 665,346

[22] Filed: Mar. 6, 1991

[51] Int. Cl.[5] ..... E04F 11/00

[52] U.S. Cl. ..... 52/187; 52/183

[58] Field of Search ..... 52/183, 187, 188, 182, 52/189; 182/178, 228

[56] References Cited

U.S. PATENT DOCUMENTS

| | | | |
|---|---|---|---|
| 432,599 | 7/1890 | Clarke | 52/187 |
| 3,740,906 | 6/1973 | Schneider | 52/187 |
| 4,527,367 | 7/1985 | Morellini | 52/187 |

FOREIGN PATENT DOCUMENTS

| | | | |
|---|---|---|---|
| 2024420 | 12/1971 | Fed. Rep. of Germany | 52/187 |
| 2520628 | 11/1976 | Fed. Rep. of Germany | 52/187 |

OTHER PUBLICATIONS

1985 Sweets Catalog, vol. 3, 51/29/Bo p. 7, Helix Stair.

*Primary Examiner*—David A. Scherbel
*Assistant Examiner*—Robert Canfield
*Attorney, Agent, or Firm*—Edwin H. Paul

[57] ABSTRACT

A circular staircase tread (10), capable of being formed in one piece, the tread having a flexible stacking (18), positioning and locking mechanism which allows on-site adjustment of the angular positioning of the treads in relation to each other and the on site modification of the resulting staircase.

7 Claims, 3 Drawing Sheets

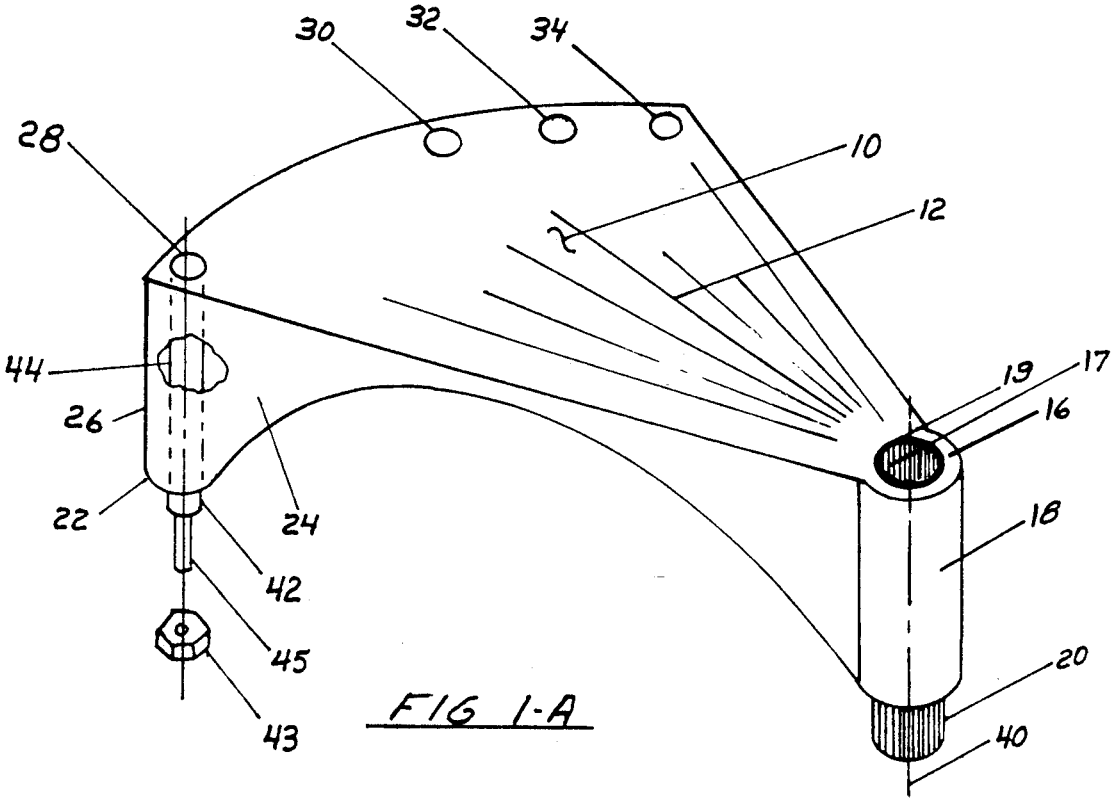
FIG 1-A
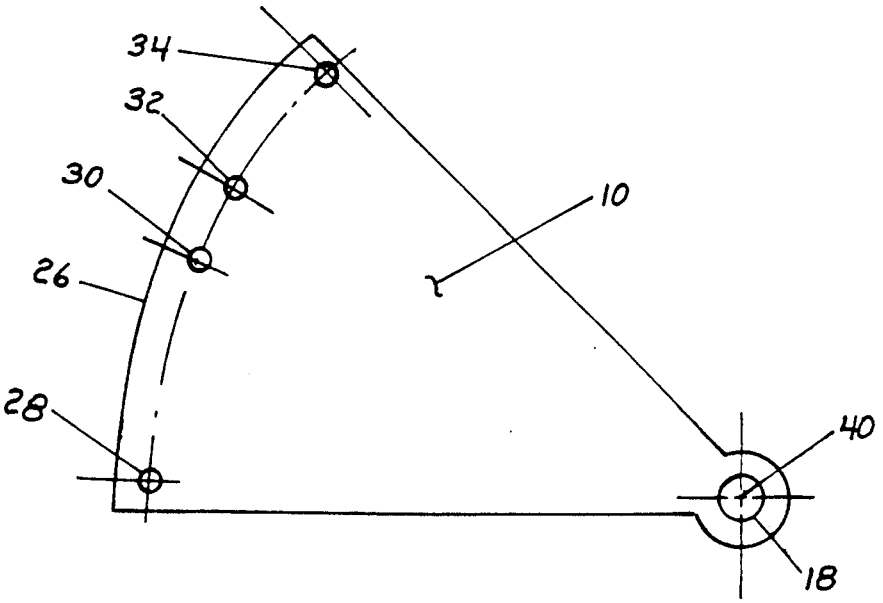
FIG 1-B

STAIRTREAD WITH POSITIONING AND LOCKING MECHANISM

FIELD OF THE INVENTION

This invention relates generally to the design and construction of spiral staircases. These staircases have been used for many years as outside ways into upper levels of buildings and as emergency escape staircases. They are used in many circumstances where there is not enough space for a conventional staircase. These spiral staircases have developed over the years and usually are built from wood, steel and aluminum.

BACKGROUND OF THE INVENTION

The construction techniques used for a spiral staircase have developed from the use of wood where the pieces are cut and assembled at the site where the staircase is to be used, to factory assembled sections where these sections are assembled at the site. However the sections are heavy and difficult for a do-it-yourself home owner to assemble.

The sections usually consist of a single tread connected to an upright shaft, the treads are to be stacked forming a staircase. There is an angular rotation of each tread which forms a spiral pattern when stacked, as the staircase rises around the shaft. The staircase may wrap completely around as it ascends to the next level. These ascending treads are joined to each other by welding, nailing or bolting. In many cases there is a railing at the opposite end of the tread from the shaft.

Other manufacturers ship sections consisting of several treads already joined together. These sections are stacked at the site to form the staircase.

There are problems with setting the desired angular rotation for each step. For example, if the height to be traversed by the stairway is known and the rise and the angular position of one step to the next step is set by the manufacturer, then the position where the stairway terminates is fixed. Since the manufacturer sets these dimensions for the treads, the user cannot change these dimensions at the building site. The user is locked into the dimensions.

The preassembled treads are heavy and unwieldy since they are made of steel, concrete, or structural wood. Also if a section is damaged after the staircase is built, it is very difficult to replace or repair.

It is an object of this invention to form a lightweight modular tread design which can be stacked forming a spiral staircase, and where the tread can be formed as one piece.

It is a further object of this invention to create a flexible design so the angular rotation of the treads, as stacked to form the staircase, can be modified at the building site.

It is a further object of this invention to position the treads with a keying mechanism which locks the treads to one another.

It is another object of this invention to have a positioning and locking means which is fastened simply with a nut and bolt requiring little strength.

It yet another object of this invention to form a staircase which is inexpensive to manufacture, ship and build.

SUMMARY OF THE INVENTION

The herein described invention is a tread formed from a slab or block of material which includes a keyed and locking design which allows a simplified and less costly assembly at the building site. When a lightweight material, such as plastic or a polymer plastic, is used the assembly requires no special skills or strength. With less weight the shipping, loading and handling cost are proportionately reduced.

The invention incorporates a keying means which may have many configurations. In the preferred case a toothed tubular recess and mating extension is used. But a nut pattern, a post and hole, a mortise and tenon or any combination of fitted parts which mate with one another may be used. There need be no welding, nailing or bolting using excessive force. The light modular treads stack on top of one another with the keyed pattern of one tread fitting into the corresponding keyed pattern receptacle of the next tread above and below.

The treads as described above have flexible angular positioning means where the user can fit the staircase to the particular application. Each tread is independently set at the angle desired by the user at the site. Each tread has a locking and stacking means wherein each tread is positioned in a stack and locked into the position. In addition the treads can be taken apart and the angles changed.

For example, an angular position means with a ten degree repeating pattern would allow the angular rotation between one tread and the next to be any ten degree increment (even up to 360) for the particular application. In deed the precision of the angular repeating pattern can be as fine as required. the actual angular degree can be modified so that the top of the staircase will evenly meet the height of the next floor without excessive calculations and with the ability to modify the design at the building site.

The weight of the staircase will be shared by the shaft at one end of the tread and a support between the treads at the other end. The support at the end opposite the shaft will usually be combined with a structure connected to a hand railing. The first tread will typically be anchored to a concrete pad or platform. This pad must be strong enough to support the staircase itself and the people walking on the staircase.

BRIEF DESCRIPTION OF THE DRAWINGS

FIG. 1A is an isometric view of one stair tread.

FIG. 1B is a view of the tread from above.

PREFERRED EMBODIMENT

Figure 2A:
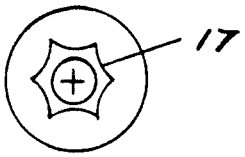
FIGS. 2A and 2C are cross section views of the recessed end of the shaft and the extension end of the shaft, respectively.
Figure 2B:
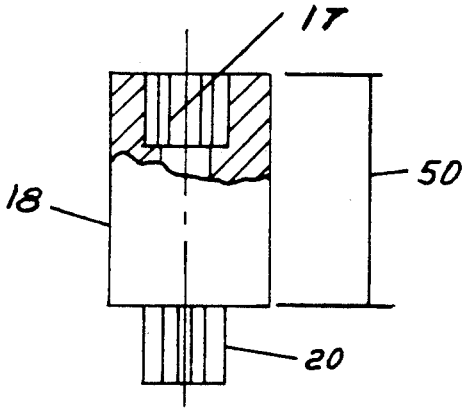
FIG. 2B is a sectioned detail of one type of locking positioning built into the shaft of the tread.

Referring to FIG. 1A, the top surface 10 of the tread is designed for walking and is roughened 12 to prevent slipping. One end of the tread forms a cylindrical shaft 18 with an axis 40 generally vertical to the tread surface 10. In this embodiment the top 16 of the shaft 18 has a tubular recess 17 along the axis 40, and a corresponding extension 20 projecting from the bottom of the shaft 18. Projections, teeth or grooves or the like 19, are distributed along the walls of the recess 17 and the extension 20. The teeth on the recess 17 are designed to accept and mate with the teeth on the extension 20.

The front 24 of the tread may be shaped for rigidity and strength. In this tread shown in FIG. 1 a decorative arch shape which lends structural rigidity is used, but others or none may be used.

FIG. 1B shows the top 10 surface of the tread. The end 26 of the tread is formed with a plurality of knockouts 30, 32,and 34. Knockout 30 is positioned at 22.5 degrees from a line extending from the center axis 40 of the shaft 18 and the position 28 of the tread. Position 28 is designed to accept a handrail (not shown). The knockout 32 is positioned at 30 degrees and the knockout 34 is positioned at 45 degrees. These angles accommodate a wide range of possible designs. However, the knockouts could be placed at any angle, or anywhere on the top surface 10 of the tread.

Referring back to FIGS. 1A and 1B, the front 24 of the tread is formed into an extension 22 at the end 26. This extension 22 terminates with a nipple 42. This nipple 42 is designed to fit into one of the knockouts 30, 32 or 34 when the removable part of the knockout is taken out. The nipple 42 is formed with a through hole 44. A nut 43 and bolt 45 is used to fasten each tread to the next. The axis of this hole 44, and the nut 43 and bolt 45 align with position 28. As shown, the bolt 45 extends upward through the hole 44 and the head of the bolt 45 is flush with the top surface 10. This bolt 45 could be an extension of a hand rail support.

The weight of the tread 10 rests on this position 20 of a tread (not shown) below. Also a support for a hand rail (not shown) may extend upward. Position 28 accepts the load placed on the hand rail.

The teeth 19 on the wall of the tubular recess 17 are positioned to accept the extension 20 at the angles needed to position the treads at the corresponding angles of 22.5, 30 and 45 degrees. The recess 17 and the extension 20, when mated form a stacking and locking means. However there may be no locking or angular positioning relationship in the shaft 18. In this case the locking of one tread to the next will be determined by the bolting of one tread to the other at the knockouts 30, 32, 34 and the nipple 44.

Figure 2C:
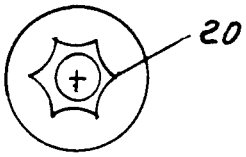

FIG. 2C is a sectioned view of the shaft 18. The recess 17 may extend down to any reasonable depth and the extensions 20 will be correspondingly as long. The rise of one step is determined from the height 50 of the shaft 18. But separate extensions could be used to increase or otherwise allow flexibility in determining the rise of any step. An alternate design may use a nut shaped recess 17 formed in the top of the shaft 18, and a matching extension 20 from the bottom surface of the shaft 18. Where the extension 20 is designed to fit into the recess 17, as before. The angles of the recess 17 and extension 20 are formed to allow the joining of one tread to another at any of the angles defined by the cutouts 30, 32 and 34. FIGS. 2A and 2C show, in cross section, the grooves on the recess 17 surface and the matching projections on the extension 20.

Figure 3:
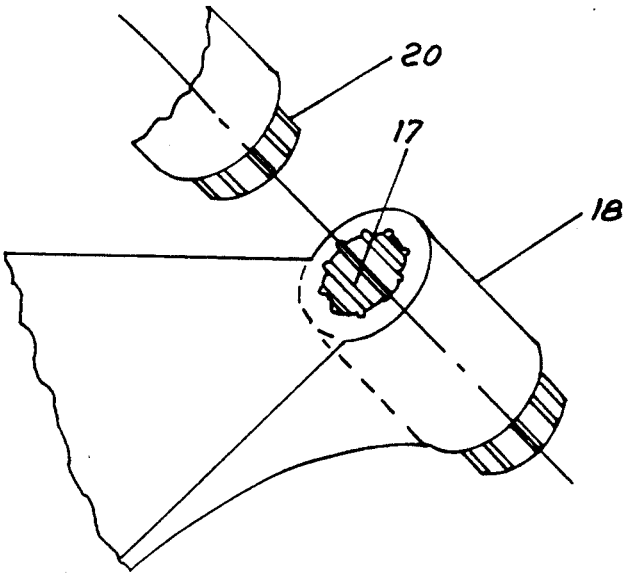
FIG. 3 is an isometric view of the positioning of two treads as they are to be joined.

FIG. 3 shows in an isometric pictorial the joining of the recess 17 and the extensions 20 of the shaft 18 of one tread to the next.

Figure 4:
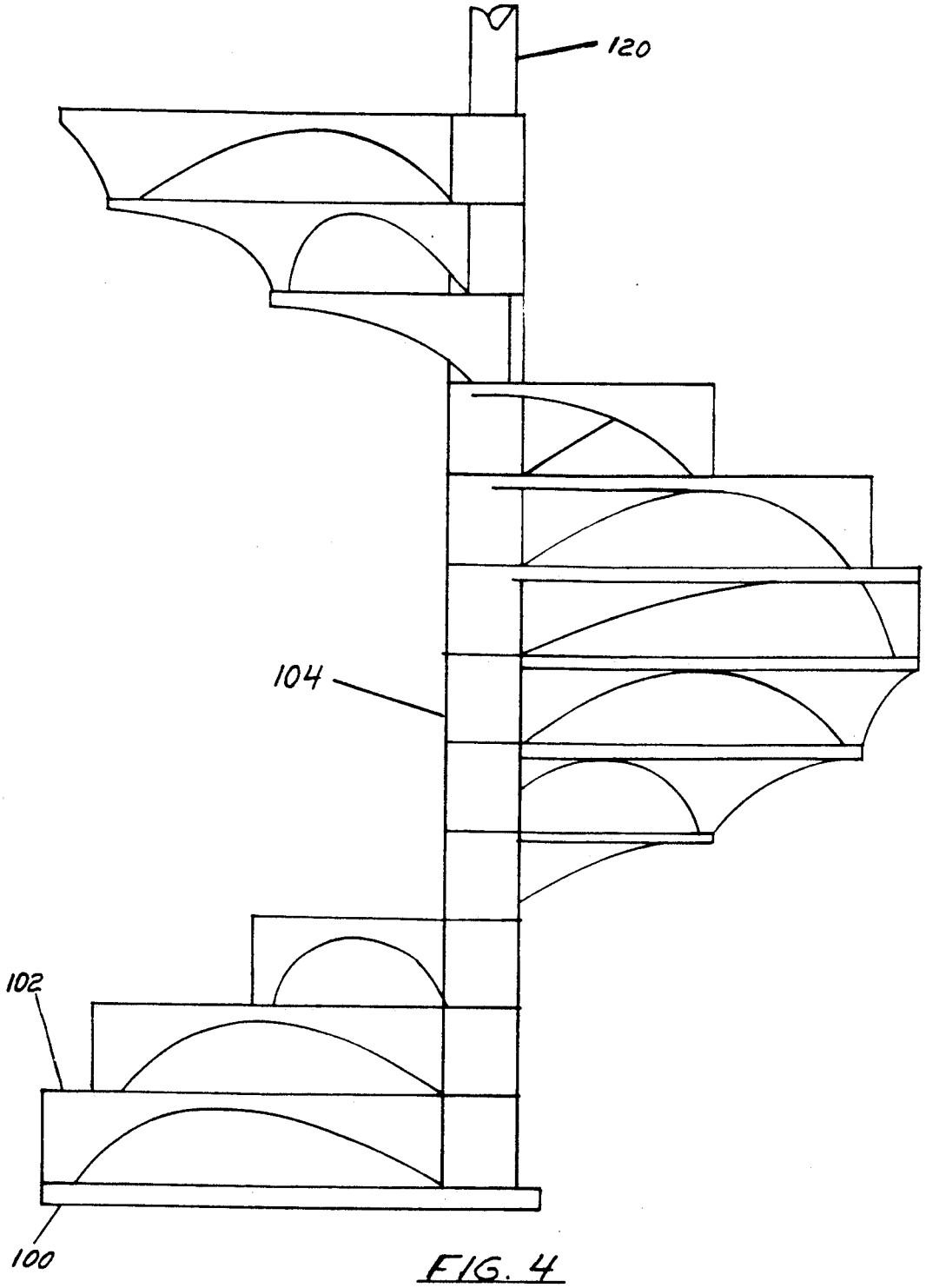
FIG. 4 is an isometric view of an entire staircase.

FIG. 4 shows a completed staircase. The bottom tread 102 is anchored to a platform or pad 100 and the shafts of each tread 18 are joined together forming a central post 104. Here the shaft of the bottom tread fits into a formed receptacle built into the platform 104. Also a supporting rod 120 may be fitted into the central shaft 104 for additional strength and rigidity.

It will be apparent to those skilled in the art that other embodiments, improvements, details and uses can be made consistent with the letter and the spirit of the foregoing disclosure and within the scope of this patent, which is limited only by the following claims, construed in accordance with the patent law, including the Doctrine of Equivalents.

What is claimed is:

1. A stairtread comprising:

a slab with a top and a bottom surface, said top surface arranged and constructed for stepping upon, joining means comprising a shaft with an upper and a lower surface, said shaft having a shaft axis, said shaft attached to said slab with shaft extending, in an approximately normal direction to said slab top surface, said normal direction defining a longitudinal direction, wherein said upper surface is designed and constructed to form a stacking means and wherein said lower surface is designed and constructed to provide a complementary stacking means corresponding to said stacking means, wherein said stacking and complementary stacking means are designed and constructed with at least one longitudinal recess or extension on the upper and lower shaft surfaces, wherein said recesses and extensions on the upper shaft surface matingly correspond to the recesses and extensions on the lower shaft surface, said mating surfaces forming a locking means comprising: longitudinally arranged grooves, teeth, projections or angular surfaces on said recesses and extensions, wherein said longitudinal grooves, teeth, projections and angular surfaces define a plurality of angular positions with respect to said shaft axis and wherein mating two such stacking means selects one of the plurality of angular positions and such mating prevents rotational motion around said shaft axis.

2. A stairtread as defined in claim 1 further comprising: a plurality of knockouts on the stepping surface wherein said knockouts define a plurality of angular positions with respect to sad shaft axis, and wherein said knockout angular potions correspond to angular positions defined by said stacking means.

3. A spiral stairtread comprising:

a slab with a top and a bottom surface, said top surface arranged and constructed for stepping upon, a cylindrical shaft, with upper and lower surfaces, attached to said slab and disposed at one end of said slab, said cylindrical shaft having a cylindrical shaft axis with the cylindrical shaft axis normal to said slab top surface, said normal direction defining a longitudinal direction, one of said cylindrical upper and lower surfaces constructed and arranged with a longitudinally recessed chamber, said recessed chamber having an inner surface with grooves, said grooves running generally longitudinally and parallel with the axis of the cylinder, along the inner surface of the recessed chamber, the other of said cylinder upper or lower surfaces constructed and arranged with an axial cylindrical extension, said extension matingly arranged to correspond with said recessed chamber, said extension having projections running generally longitudinally and parallel with the axis of the cylinder, along the outer surface of the extension, wherein said grooves on the recessed chamber inner surface and said projections on the cylindrical extension outer surface, are constructed and arranged to mate, and wherein said mating defines a plurality of angular positions with respect to said cylindrical shaft axis, and wherein said mating selects one of the plurality of angular positions and prevents rotational motion around said shaft axis.

4. A stairtread as defined in claim 3 wherein said grooves and projections are formed as mating teeth or angular surfaces.

5. A stairtread as defined in claim 4 further comprising a plurality of knockouts on the stepping surface wherein said knockouts define a plurality of angular positions with respect to said cylindrical shaft axis of the cylinder and wherein said knockout angular positions correspond to angular positions defined by said mating grooves and projections.

6. A stairtread as defined in claim 5 wherein said stairtread comprises one piece.

7. A spiral staircase comprising:

a plurality of said stairtreads as defined in claim 5, each stacked upon each other, wherein said stairtreads are distributed around said cylinder shaft axis.

* * * * *